United States Patent [19]

Athey

[11] Patent Number: 4,684,095

[45] Date of Patent: Aug. 4, 1987

[54] CURTAIN ROD AND WINDOW SHADE HOLDER

[76] Inventor: Wilber J. Athey, Rte. 1, Box 39, Clinton, Minn. 56225

[21] Appl. No.: 858,668

[22] Filed: May 2, 1986

[51] Int. Cl.[4] ..... A47H 1/14

[52] U.S. Cl. ..... 248/255; 160/323 B; 248/263; 248/300

[58] Field of Search ..... 248/255, 254, 252, 251, 248/253, 263, 264, 268, 267, 300; 160/323 R, 323 B

[56] References Cited

U.S. PATENT DOCUMENTS

| | | | |
|---|---|---|---|
| 1,525,895 | 2/1925 | Sherwood | 248/254 |
| 1,571,760 | 2/1926 | Dick . | |
| 1,873,506 | 8/1932 | Sullivan . | |
| 1,903,340 | 4/1933 | McCullough . | |
| 2,225,281 | 12/1940 | Speranza | 248/253 X |
| 2,386,854 | 10/1945 | Hilton | 248/254 |
| 2,506,160 | 5/1950 | Martin et al. | 248/255 |
| 2,508,737 | 5/1950 | Zeto | 248/263 |
| 2,706,100 | 4/1955 | Thomason | 248/255 |
| 2,738,154 | 3/1956 | Mason | 248/255 |
| 3,218,017 | 11/1965 | Butler | 248/263 |
| 3,857,538 | 12/1974 | Williamson | 248/263 |
| 3,889,912 | 6/1975 | Ray | 248/255 |
| 4,226,395 | 10/1980 | Bellinger | 248/255 X |
| 4,455,007 | 6/1984 | Varon et al. | 248/300 X |

*Primary Examiner*—Ramon O. Ramirez

*Attorney, Agent, or Firm*—Kinney & Lange

[57] ABSTRACT

A curtain rod and window shade holder formed of a metal sheet having a main portion with an arcuate lower edge, a flat upper edge, and a rear portion which is bent to hook over a window frame, the sheet having a curtain rod holding portion struck outwardly from an intermediate portion of the main portion to receive the end of a conventional curtain rod of the channel type. The curtain rod and window shade holder also has an opening to receive a pin of a window shade roller. There is a right and left window shade holder, and one of these has a slot to receive a flat pin of a roller shade and the other has a circular opening to receive a round pin. In addition, there are openings extending downwardly from the flat upper edges of the sheet to receive round curtain rods. The whole unit can be formed by a simple stamping operation from a single flat piece of metal.

6 Claims, 5 Drawing Figures

CURTAIN ROD AND WINDOW SHADE HOLDER

BACKGROUND OF THE INVENTION

1. Field of the Invention

The present invention is concerned with a curtain rod and window shade holder stamped out of a flat piece of metal.

2. Description of the Prior Art

In a commonly used type of curtain rod and window shade holder, it is necessary to approximately locate the holder on the window frame, mark the location of the desired openings for the screws or other fastening means, remove the bracket, drill the holes and then reapply the bracket with the hope that the holes are in the right place. These brackets are often at an elevated position which makes the drilling of the holes and the subsequent insertion of the screw fasteners difficult. Often, it turns out that the screw openings which have been drilled are not in quite the right position.

As the result of the difficulties with the typical curtain rod and window shade holder, various attempts have been made to align such holders with the edge of the window frame, using the window frame to partially anchor the holder in position. As an example, the Martin et al. U.S. Pat. No. 2,506,160 shows a metal holder stamped out of sheet metal in which the top of the holder hooks over the window frame. The shade holders are struck out from the sheet metal and in order to make the the shade holders more stable, reinforcing members 11 are also struck out to provide support for the shade holders 14.

The Dick U.S. Pat. No. 1,571,760 shows another arrangement for a window shade and curtain holder which is stamped out of sheet metal. Here, the upper edge is turned over and there are a series of prongs 6 which can be driven into the top of the window frame. The window shade is supported by a pair of forwardly extending arms 9 which are bent outwardly from the lower portion of the metal which is relatively narrow. There would be considerable question as to how rigid these arms would be. The window shade holders are the portion of such a bracket which takes the greatest stress, particularly if the spring within the roller is tightened up so as to insure that the shade returns to its uppermost position.

The McCullough U.S. Pat. No. 1,903,340 shows an arrangement which can also be stamped out of a single sheet of metal. Again, the shade roller supporting arms 13 extend outwardly from the base member and would be less capable of supporting a severe thrust. Furthermore, while McCullough has a prong 15 at the bottom to go into the window casing, he has no means at the top to go over the top of the window casing.

Other patents that are of interest are the Sullivan U.S. Pat. No. 1,873,506, the Thomason U.S. Pat. No. 2,706,100, the Mason U.S. Pat. No. 2,738,154 and the Ray U.S. Pat. No. 3,889,912. None of these patents show an arrangement which can be stamped out of a single sheet of metal and which hooks over the top of a window casing.

SUMMARY OF THE INVENTION

The present invention is concerned with a curtain rod and window shade holder which is formed of a metal sheet having a main portion with an arcuate lower edge in which the main portion has an opening therein to receive the end pin of a window shade holder. The sheet not only has a main portion, but also a flat upper edge and a narrow rear portion which extends the full height of the main portion and projects upwardly therefrom, this narrow rear portion being bent perpendicularly with respect to the plane of the main portion to engage a window frame and having the upwardly projecting portion bent backwardly and then downwardly to provide a hook portion to engage over the top of the window frame and extend downwardly between the frame and the wall to which the frame is attached. The main portion of the sheet has a curtain rod holding portion struck outwardly from an intermediate part of the main portion and then bent forwardly and cut to provide a hook member to receive the end of a conventional curtain rod of the channeled type. The curtain rod and window shade holder of the present invention has a notch in the flat upper edge thereof to receive one end of a curtain rod of cylindrical cross section.

The opening to receive the end pin of a window shade roller may be a slot which communicates its upper end with an opening in the main portion resulting from striking out the curtain rod holding portion. The outwardly projecting portion which engages the window casing has an aperture therethrough in its lower part for receiving a fastening member to fasten a portion of the window frame. The curtain rod holding portion which is struck outwardly from the main portion of the sheet is preferably struck outwardly along the inner edge of the upwardly projecting portions so that a part thereof is in engagement with the window frame when the holder is secured to the window frame. This tends to make the curtain rod holder much more stable. It is contemplated that there would be two such curtain rod and window shade holders, one functioning as a right hand holder and the other as a left hand holder, the the shade roller pin opening of one holder being circular and the shade roller pin opening of the other being in the form of a slot to receive the flat pin of a shade roller.

Various other features of the invention will be apparent from the accompanying description of the specification, claims and drawings.

DETAILED DESCRIPTION OF THE PREFERRED EMBODIMENTS

Figure 1:
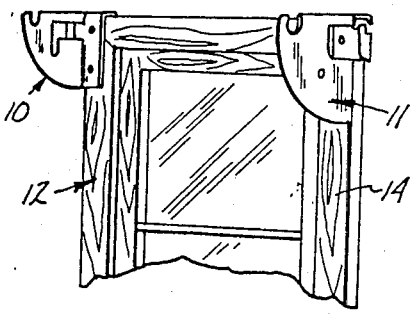
FIG. 1 is a perspective view of the upper portion of a window with a set of my improved curtain rod and window shade holders secured thereto.

Referring to FIG. 1, there is shown a left hand curtain rod and window shade holder 10 and a right hand curtain rod and window shade holder 11, both secured to a window 12 having a frame 14 of conventional construction. In the typical case, the frame is made of wood having side panels and vertical panels.

Figure 2:
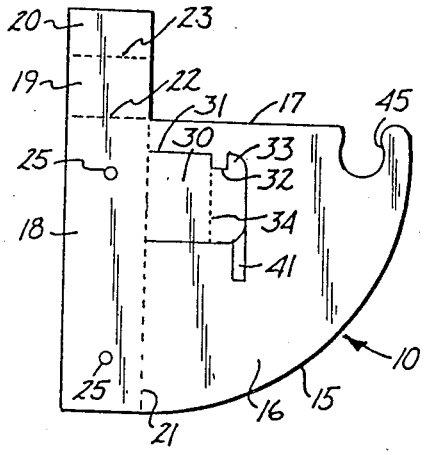
FIG. 2 is a plan view of a sheet metal blank from which my left hand curtain rod and window shade holder is formed.
Figure 3:
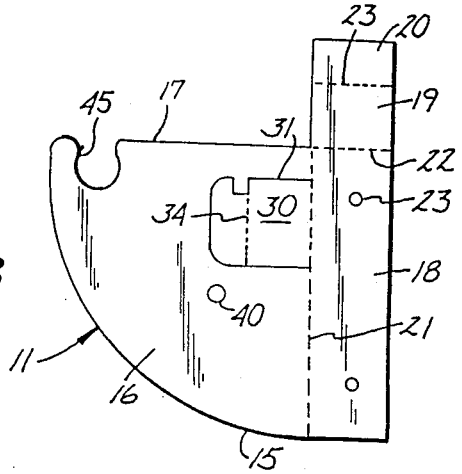
FIG. 3 is a view similar to FIG. 2, but showing the sheet metal blank from which the right hand holder is formed.
Figure 4:
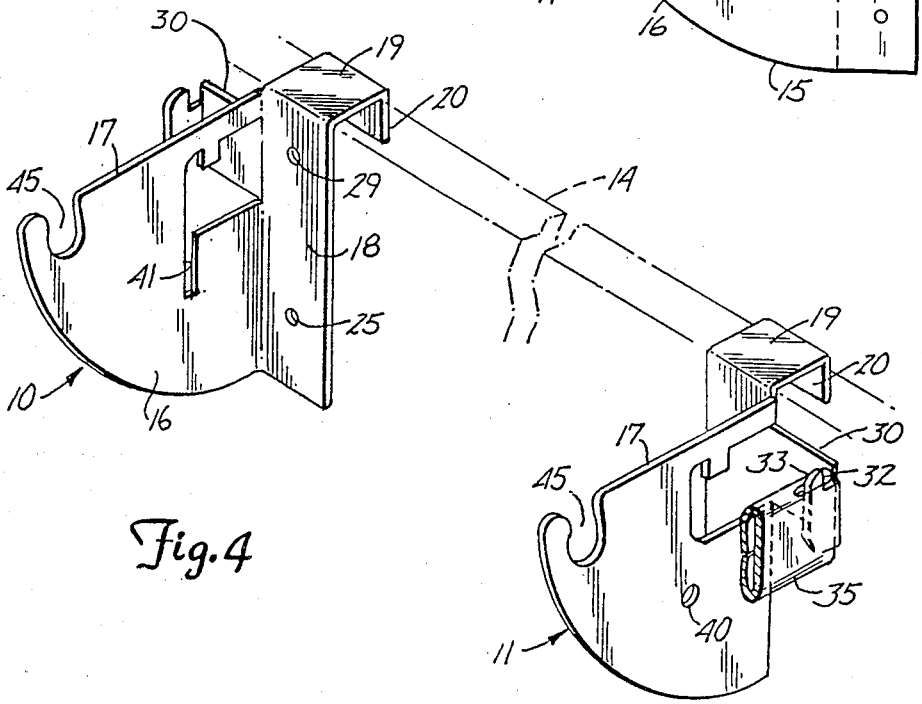
FIG. 4 is a perspective view on a larger scale than FIG. 1 showing the left and right hand curtain rod and window shade holders in position on the frame of a window.

Referring to FIGS. 2 and 3, the two blanks from which the left and right hand holders are formed are identical except for the portions supporting the shade, which will be discussed later. As shown, the two are basically mirror images of each other. It is to be understood that by reversing either one, the blanks can be identical for both left and right hand holders, the sole exception being in connection with the window shade holder, as mentioned above. In order to simplify the description, the same reference numerals have been applied to the identical elements of FIGS. 2 and 3. Thus referring to FIG. 2, the sheet metal blank has a main portion 16 with a curved lower edge 15. The blank has a flat upper edge 17 and an upwardly extending member 18 at the rear of the main portion 16, this upwardly extending member 18 having two portions 19 and 20 which project above the upper flat edge 17. The rear upwardly extending member 18 is adapted to be folded at right angles to the plane of the blank about a fold line 21, shown in dotted lines. When so folded, it can lie flat against the window frame with the main portion 16 projecting outwardly at right angles to the window frame. The upper portion 19 is bent inwardly about a fold line 22. This is bent so as to be at an angle of 90° with respect to the plane of the upwardly extending member 18. The uppermost portion 20 is similarly bent about a fold line 23. Thus, as best shown in FIG. 4, the member 18 and the folded portions 19 and 20 form a hook. Portion 20 is designed to engage between the frame 14 and the wall surface to which it is secured. When so inserted, as shown in FIG. 4, the curtain rod holder is held relatively securely without the addition of further fastening means. In order, however, to thoroughly anchor the holder of the present invention, the member 18 is provided with a plurality of apertures 25 through which suitable fastening means, such as nails or screws, can be inserted and secured to the window frame. In actual practice, it probably is only necessary to use the lower of these two openings since the unit is already secured by reason of the lip 20 extending down between the frame 14 and the wall. By using fasteners, such as screws, in both the openings 25, it is possible to secure the holder very rigidly to the window frame. Since the holder is already rigidly held in place by reason of being hooked over the window frame, it is easy to insert the fastening members through the openings 25.

Each of the blanks of FIGS. 2 and 3 also has a curtain rod holding portion 30, which is struck out from the main portion 16 of the blank. The curtain rod holding portion 30 is bent outwardly at right angles to the bracket along the fold line 21. It is to be understood that the vertical member 18 is bent forwardly out of the plane of the sheet metal (as viewed in FIG. 2) while the curtain rod holding portion 30 is bent rearwardly out of the plane of the sheet metal. The curtain rod portion 30 is defined by an edge 31 which is cut away to provide a notch 32 bounded on its outer side by a hook portion 33. The portion 30 can be bent by a suitable die, which simultaneously bends the portion 30 out of the plane of the sheet metal and at the same time severs the metal along the edges of portion 30. The forwardmost portion of the holder portion 30 is bent along a further fold line 34, being bent forwardly so that it lies parallel to the main portion of the sheet metal blank. This is best shown in FIG. 4.

Figure 5:
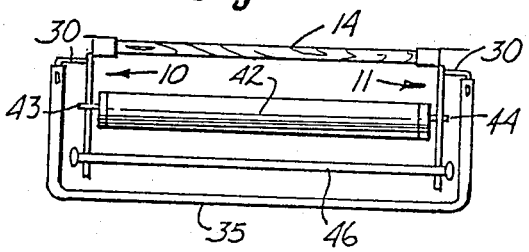
FIG. 5 is a top plan view of an assembly showing left and right hand curtain rod and window shade holders secured to the frame of a window and with a roller shade, a curtain rod of circular cross-section, and a curtain rod of the channeled type supported by the holders.

The result of displacing the curtain rod holding portion 30 outwardly and then bending its forward portion in again is to produce a hook designed to receive the conventional curtain rod of the channel type. This is best shown in FIGS. 4 and 5, in which the curtain rod is indicated by the reference numeral 35. In FIG. 5, the curtain rod holder 35 is hooked over the curtain rod holder portions 30. The curtain rod is of the channel type, as best shown in FIG. 4 in which a portion of such a rod is shown as being secured to curtain rod holder 11. The upper wall of the curtain rod 35 has an opening through which the hook 33 extends and the curtain rod is tilted (referring to FIGS. 2 and 3) until the curtain rod is horizontal. In this position, the curtain rod is thoroughly locked to the curtain rod holders. This method of securing such a curtain rod to curtain rod holders is conventional.

The sheet metal blank of FIG. 3 is similar in all respects to that of FIG. 2, as far as the description up to this point is concerned. The vertical member 18 of FIG. 3 is bent in the opposite direction of the vertical member 18 of member 10 so that both of these members face inwardly. Similarly, the curtain rod holding portion 30, being bent outwardly as best shown in FIGS. 1 and 4, is obviously bent in the opposite direction from the curtain rod holder portion 30.

One major difference between the two units is in the means for holding a roller shade. Such roller shades conventionally have a round pin at one end and a flat pin at the other. These pins support the shade. The flat pin forms part of a roller shaft which acts on an internal spring to place tension on the shade so that the shade tends to roll up when released. When it is drawn downwardly, the spring is tensioned. The flat pin is necessary to apply such tension to the spring. Referring specifically to the drawing, the means for holding the roller shade consists of a circular aperture 40 in member 11, and a slot 41 in member 10. As best shown in FIG. 4, the slot 41 extends upwardly and communicates with the space in the member 10 provided by striking out portion 30. It will thus be apparent that a roller shade can be placed in position by inserting the round pin through the opening 40 and then inserting the flat pin into the slot 41 by inserting it first into the space provided by striking out the portion 30 and then lowering it into slot 41. Inasmuch as the opening 40 and slot 41 are provided in the main portions of the holders 10 and 11 rather than in separate outwardly bent arms, there is considerable stability in the portions of the holders supporting the roller shades. This is important since considerable force is often exerted upon the shade in unrolling the same. This is particularly true if the spring is initially tensioned to a considerably degree. With my arrangement, the portions supporting the roller shade are very stable and can withstand the force applied. The roller shade is indicated by the reference numeral 42, the flat pin by the reference numeral 43, and the round pin by the reference numeral 44.

The members 10 and 11 each have notches 45 in the upper portion extending downwardly from the flat edge 17. A typical curtain rod of circular cross-section is shown in FIG. 5 and designated by the reference numeral 46. The curtain rod is of circular cross-section and is designed to rest in the circular openings 45. Since the center of these openings 45, as shown in FIGS. 2, 3 and 4, is somewhat below the upper edge 17, the curtain rod is securely held within the openings 45.

The reason for both the channel type of curtain rod 35 and the round type of rod 46 is that it is often customary to use an outer channel type of rod for supporting drapes and an inner rod of circular cross-section for supporting "glass curtains".

CONCLUSION

It will be seen that I have provided a curtain rod and window shade holder which is formed of a single piece of metal and which provides rigid support for a channel type of curtain rod, a round type of curtain rod, and a roller shade. The shade holder can be quickly fastened to the frame by forcing a hook portion of the shade holder down over the upper portion of the window frame. Fastening means can then be inserted through one or the other of two openings to securely fasten the holder to the window frame. Because of the hook type of construction which fits over the top of the window frame, it is possible to quickly and firmly secure the window shade holder to the window frame.

While I have shown a specific embodiment of my invention for purposes of illustration, it is to be understood that the invention is limited solely by the appended claims.

What is claimed is:

1. A curtain rod and window shade holder comprising:

a sheet of rigid material having a main portion bounded by an arcuate lower edge, a flat upper edge and a narrow rear portion extending the full height of said main portion and projecting upwardly therefrom, said arcuate lower edge extending from the lower end of the narrow rear portion to the outer end of the flat upper edge, said narrow rear portion being bent perpendicularly with respect to the plane of the main portion to engage a window frame and having the upwardly projecting portion thereof bent backwardly and then bent downwardly to provide a hook portion to engage over the top of a window frame and extend downwardly between the frame and the wall to which the frame is attached; and said sheet having a curtain rod holding portion struck outwardly from an intermediate part of the main portion to leave an opening through said main portion, the outer part of said struck out portion being bent again so as to extend outwardly parallel to the main portion and being cut to provide a hook member to receive the end of a conventional curtain rod of the channeled type.

2. The curtain rod and window shade holder of claim 1 in which the main portion of the sheet has a notch in the flat upper edge thereof to receive one end of a curtain rod of cylindrical cross-section.

3. The curtain rod and window shade holder of claim 1 in which the main portion has a slot to receive the end pin of a window shade roller, which slot communicates at its upper end with an opening in the main portion resulting from striking out the curtain rod holding portion.

4. The curtain rod and window shade holder of claim 1 in which the upwardly projecting portion has an aperture therethrough in the lower part thereof for receiving a fastening member to fasten said portion to the window frame.

5. The curtain rod and window shade holder of claim 1 in which the curtain rod holding portion is struck outwardly along the inner edge of the upwardly projecting portion so that a part thereof is in engagement with the window frame when the holder is secured to the window frame.

6. In combination, a plurality of curtain rod and window shade holders as set out in claim 1 in which one functions as a right hand holder and the other as a left hand holder and in which there is a circular roller pin opening in one holder and a slot in the other holder to receive the flat pin of a shade roller.

* * * * *